US008547190B2

(12) United States Patent
Gassmann et al.

(10) Patent No.: US 8,547,190 B2
(45) Date of Patent: Oct. 1, 2013

(54) TRIPPING APPARATUS, PARTICULARLY FOR CIRCUIT BREAKERS

(75) Inventors: Jörg Gassmann, Dresden (DE); Matthias Kulke, Dresden (DE); Thomas Müller, Dresden (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/145,619

(22) PCT Filed: Jan. 22, 2010

(86) PCT No.: PCT/DE2010/000061
§ 371 (c)(1),
(2), (4) Date: Jul. 21, 2011

(87) PCT Pub. No.: WO2010/088875
PCT Pub. Date: Aug. 12, 2010

(65) Prior Publication Data

US 2012/0018287 A1 Jan. 26, 2012

(30) Foreign Application Priority Data

Feb. 5, 2009 (DE) ..... 10 2009 007 586

(51) Int. Cl.
*H01H 9/00* (2006.01)

(52) U.S. Cl.
USPC ..... 335/172; 335/174

(58) Field of Classification Search
USPC ..... 335/172–174
See application file for complete search history.

(56) References Cited

U.S. PATENT DOCUMENTS 4,620,171 A * 10/1986 Bagalini ..... 335/20
5,107,236 A * 4/1992 Lesslie et al. ..... 335/132
5,119,053 A * 6/1992 Mostosi ..... 335/6

(Continued)

FOREIGN PATENT DOCUMENTS

DE 68907424 T2 2/1994
DE 68920565 T2 8/1995

(Continued)

OTHER PUBLICATIONS

International Search Report for German Application No. DE 10 2009 007 586.0.

(Continued)

*Primary Examiner* — Alexander Talpalatski
(74) *Attorney, Agent, or Firm* — Harness, Dickey & Pierce, P.L.C.

(57) ABSTRACT

At least one embodiment of the invention relates to a tripping apparatus, particularly for circuit breakers, which includes at least one controllable tripping magnet having an armature that is operatively connected to a downstream tripping gear, which engages in a tripping mechanism that acts on the circuit breaker and is coupled to a preloaded spring serving as a force amplifier. According to at least one embodiment of the invention, the tripping mechanism includes a camshaft having a plurality of cam lobes, wherein at least one actuating device is associated with each cam lobe having an offset rotational angle, and wherein, when tripped, at least two actuating processes associated with the respective actuating means take place consecutively, so that the full spring force is transmitted by way of the camshaft to at least one of said actuating means so as to perform the relevant actuating process.

12 Claims, 5 Drawing Sheets

(56) References Cited

U.S. PATENT DOCUMENTS

| | | | | |
|---|---|---|---|---|
| 5,343,179 | A * | 8/1994 | Pipich et al. | 335/167 |
| 5,831,499 | A * | 11/1998 | Batteux et al. | 335/9 |
| 6,150,909 | A * | 11/2000 | Meier | 335/132 |
| 6,307,455 | B1 * | 10/2001 | Dolo et al. | 335/172 |
| 7,570,139 | B2 * | 8/2009 | Spitsberg et al. | 335/167 |

FOREIGN PATENT DOCUMENTS

| | | | |
|---|---|---|---|
| EP | 0331586 | A1 | 9/1989 |
| EP | 0813219 | A1 | 12/1997 |
| JP | 2719436 | B | 3/1992 |

OTHER PUBLICATIONS

German Office Action for German Application No. DE 10 2009 007 586.0 dated Feb. 1, 2011.

Certified Priority Document for German Application No. DE 10 2009 007 586.0 (Not Yet Published).

Abstract of JP 04-098729 published Mar. 31, 1992.

* cited by examiner

FIG. 4 - PRIOR ART

TRIPPING APPARATUS, PARTICULARLY FOR CIRCUIT BREAKERS

PRIORITY STATEMENT

This application is the national phase under 35 U.S.C. §371 of PCT International Application No. PCT/DE2010/000061 which has an International filing date of Jan. 22, 2010, which designates the United States of America, and which claims priority on German patent application number DE 10 2009 007 586.0 filed Feb. 5, 2009, the entire contents of each of which are hereby incorporated herein by reference.

FIELD

At least one embodiment of the invention generally relates to a tripping device, particularly for circuit breakers. For example, at least one embodiment relates to a tripping device which comprises at least one controllable tripping magnet having an armature that is operatively connected to a downstream tripping catch, which engages in a tripping mechanism that acts on the circuit breaker and is coupled to a preloaded spring serving as a force amplifier.

BACKGROUND

Tripping apparatuses with force amplification are used for actuating circuit breakers. Circuit breakers designed for large currents can switch not only load currents and slight overload currents, but can also switch on high overload currents and short-circuit currents in the event of faults, and hold these fault currents for a predetermined time and switch them off again. The overload current relates to the weakest member of the equipment downstream of the circuit breaker, seen in the energy flow direction. In order to protect such downstream equipment against damage from overload or short-circuit, the circuit breaker should switch these currents, in conjunction with the power system protection equipment, within a defined time.

When the circuit breaker is switched on, energy is stored in a store, for example, a spring. In order to release this energy rapidly in the event of a fault and thus to be able to open the contacts of the switch, a very fast-acting tripping apparatus is needed.

From the prior art, a magnetic trip with force amplification is known which is used in the SUSOL 250A circuit breaker (from LS Industrial Systems). The basic principle of a magnetic catch tripping shaft with magnetic reset is used in that case. On tripping, the tripping' magnet moves a tripping catch with little force. Said catch releases a lever or shaft which is preloaded with a spring serving as a force amplifier. The shaft begins to rotate and simultaneously trips all the actuating processes that are to be realized, specifically tripping the breaker mechanism, pressing the auxiliary switch and resetting the tripping magnet. Since these actuating processes take place simultaneously, the energy of the spring is distributed among all the intended functions. For each individual actuating process, masses are accelerated and frictional and resistive forces are overcome. For each actuating process, therefore, only part of the currently effective spring force is available. The actuating processes therefore take place relatively slowly. However, a short tripping time is indispensible for rapid switching and for protecting the system against excessively large currents.

In order to achieve a short tripping time, the spring forces or those of the amplifying spring and the magnetic spring must be significantly increased. However, this entails having a magnet with a high power requirement, which significantly increases the production costs. These measures also require greater space, which is usually not available.

The switching times that are required from modern circuit breakers are, in part, no longer obtainable with the solutions that are known from the prior art. At the same time, low-energy actuators are needed for actuating the tripping catch, and this also limits the spring forces.

SUMMARY

At least one embodiment of the invention provides a tripping apparatus, particularly for circuit breakers, by which the necessary actuating processes and switching functions can be realized with small forces and within the required switching time.

At least one embodiment of the invention provides a tripping apparatus, particularly for circuit breakers, by which the necessary actuating processes at least one embodiment of the invention relates to a tripping apparatus, particularly for circuit breakers, which comprises at least one controllable tripping magnet having an armature that is operatively connected to a downstream tripping catch, which engages in a tripping mechanism that acts on the circuit breaker and is coupled to a preloaded spring serving as a force amplifier.

According to at least one embodiment of the invention, the tripping mechanism comprises a camshaft having a plurality of cam lobes, wherein at least one actuating device is associated with each cam lobe, respectively arranged at an offset rotational angle, and wherein, when tripped, at least two actuating processes associated with the respective actuating means take place consecutively, so that the full spring force is transmitted by way of the camshaft to at least one of said at least one actuating device so as to perform the relevant actuating process.

The actuating processes within the meaning of at least one embodiment of the invention are essentially the actuating process of tripping a breaker mechanism by way of the breaker mechanism lever thereof, the actuating of an auxiliary switch, preferably using an auxiliary switch pin, the reset movement of the tripping catch and the resetting of the armature of the tripping magnet, wherein the time-critical main function, the tripping of the breaker mechanism, takes place first and at maximum speed. Thus, the full spring force is available for tripping the breaker mechanism, allowing greater switching forces and leading to shorter switching times.

The individual actuating processes of triggering the breaker mechanism, actuating the auxiliary switch, resetting the tripping catch and resetting the armature preferably take place offset temporally. All the actuating processes preferably take place at least partially one after the other, i.e. sequentially, although between the end of one actuating process and the start of a subsequent actuating process, there is a safety timespan.

In this way, the energy transmitted from the spring to the camshaft is concentrated into the actuating process(es) carried out at the relevant time.

The decisive advantage of at least one embodiment of the invention therefore lies therein that the tripping time of the main function, the tripping of a breaker mechanism, can be significantly shortened relative to known solutions. The tripping apparatus according to at least one embodiment of the invention utilizes the energy of the spring force store better and thus requires less electrical tripping energy.

The at least one actuating device can perform a linear or rotational actuating movement. According to the concept of at least one embodiment of the invention, at least three actuating devices are provided, of which a first actuating device, which is configured as a breaker mechanism lever, carries out a rotational actuating movement, a second actuating device, configured as an auxiliary switch pin, carries out a linear actuating movement and a third actuating device, configured as a tripping catch, carries out a rotational actuating movement.

In a particularly advantageous embodiment of the invention, the first actuating device, configured as a breaker mechanism lever, comprises a curved contour which is configured such that, after the breaker mechanism lever reaches the end position thereof, on a further rotational movement of the camshaft caused by the spring force, the cam lobe associated with the breaker mechanism lever slides along the curved contour, wherein the rotational angle of the camshaft significantly increases without the end position of the breaker mechanism lever changing. Since, as a result of the design, the rotational angle of the shaft is defined to trip the breaker mechanism by way of the breaker mechanism lever thereof, the rotational angle of the shaft must be increased in order to permit the other functions to take place thereafter.

As a result of the increased rotational angle of the camshaft, the usable travel of the spring is increased and the energy utilization at a given maximum force increases greatly, for example, doubles.

In an example embodiment of the invention, the reset movement of the tripping catch takes place only after the breaker mechanism lever reaches the end position thereof and after the associated, but temporally offset reset movement of the armature of the tripping magnet.

In order to obtain shorter switching times, the first actuating device configured as a breaker mechanism lever has first fully completed the actuating process thereof before further actuating processes are tripped by the cam lobes of the camshaft.

In an example embodiment of the invention, the movement of the camshaft is transmitted to the breaker mechanism or the breaker mechanism lever thereof making use of a coupling mechanism.

The angle between the two spring attachments and the rotation point of the camshaft is selected, according to at least one embodiment of the invention, such that the spring work is a maximum at a given rotational angle of the camshaft.

A further solution of practical relevance lies therein that at least two tripping mechanisms are provided, arranged one after another in the direction of action of the force, i.e. in cascaded manner.

Also essential to at least one embodiment of the invention is that the tripping catch and a blocking cam each have contours configured according to the principle of point-of-action displacement, according to which the tripping catch can be moved with reduced force application and the latched camshaft is released quicker.

The significant advantages and features of at least one embodiment of the invention as compared with the prior art may include, essentially:

when tripped, the actuating processes associated with the respective actuating device take place temporally offset, so that for each of said actuating device, in order to perform the associated actuating process, the entire spring force is transmitted by way of the camshaft, the actuating processes provided are the tripping of the breaker mechanism, the actuation of the auxiliary switch, the reset movement of the tripping catch and the resetting of the armature of the tripping magnet, wherein the critical main function, the tripping of the breaker mechanism takes place first and at maximum speed, in that the tripping of the breaker mechanism is performed first as a time-critical actuating process, the tripping time can be significantly shortened relative to the solutions known from the prior art, a shorter tripping time is a decisive advantage in the breaker design and contributes to the development of smaller and more economical circuit breakers given the same switched currents, the breaker mechanism lever of the breaker mechanism has a curved contour which is configured such that, after assuming the end position of the breaker mechanism lever, on a further rotational movement of the camshaft caused by the spring force, the cam lobe associated with the breaker mechanism lever slides along the curve contour, so that the rotational angle of the camshaft and the travel of the spring are significantly increased, with the result that more energy can be extracted from the spring, the increase in rotational angle enables efficient use of the spring energy and the use of weaker, lower energy tripping magnets, the point-of-action displacement at the tripping catch and at the blocking cam enable the use of weaker, lower energy tripping magnets and thus also increase the tripping speed, due to the smaller forces to be activated, the electrical tripping energy necessary is reduced, which is particularly advantageous for the electronic tripping devices, which cover their energy requirement by means of the current transformers of the measuring electronics, the structural size of the tripping apparatus according to the invention is only insignificantly increased by the camshaft.

BRIEF DESCRIPTION OF THE DRAWINGS

The aims and advantages of embodiments of the invention can be better understood and evaluated by careful study of the following detailed description of the preferred, non-restrictive example embodiments of the invention together with the associated drawings, in which:

FIG. 4 is a graphical representation to illustrate the travel or rotational angle as a function of time for all actuating processes in the prior art.

DESCRIPTION OF THE EXAMPLE EMBODIMENTS

Figure 1:
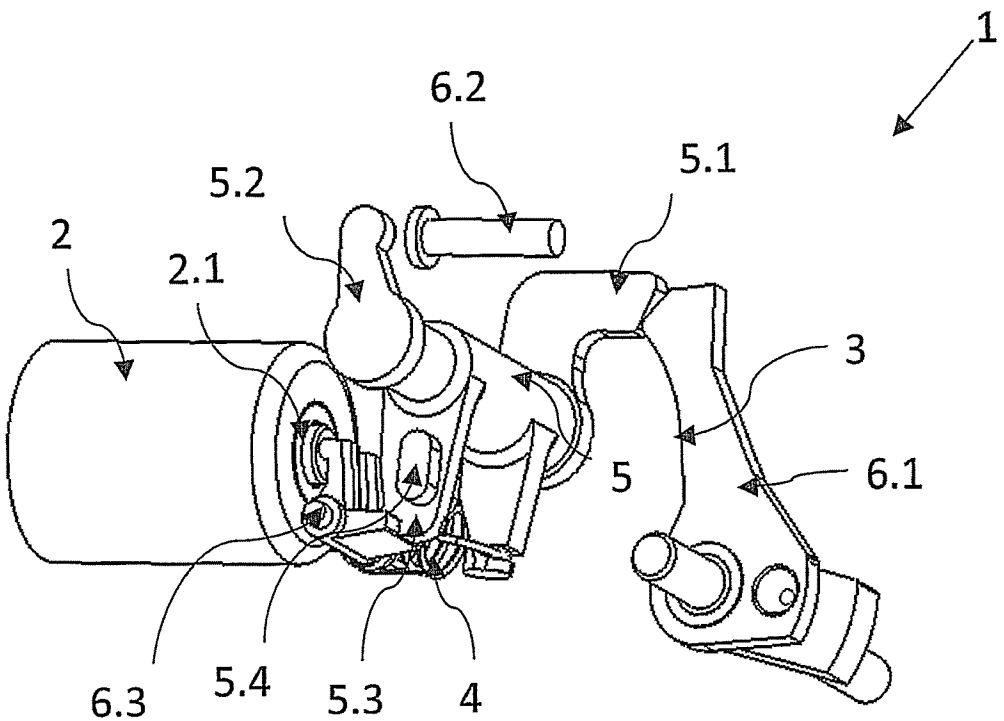
FIG. 1 is a perspective representation of the tripping apparatus in the starting position thereof.
Figure 2:
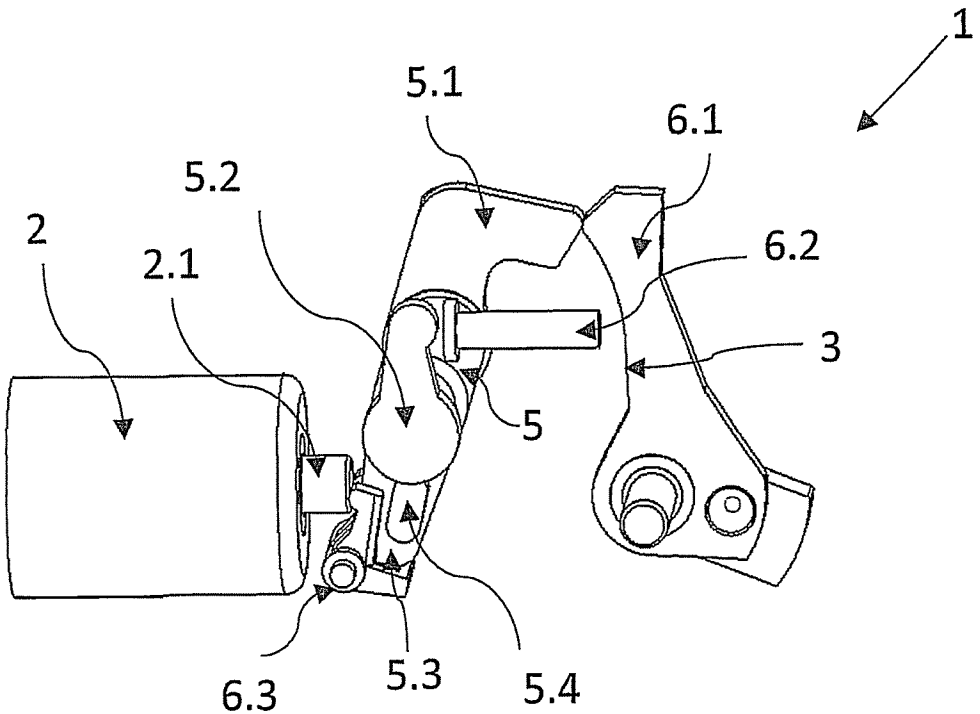
FIG. 2 is a perspective representation of the tripping apparatus in the intermediate position thereof.
Figure 3:
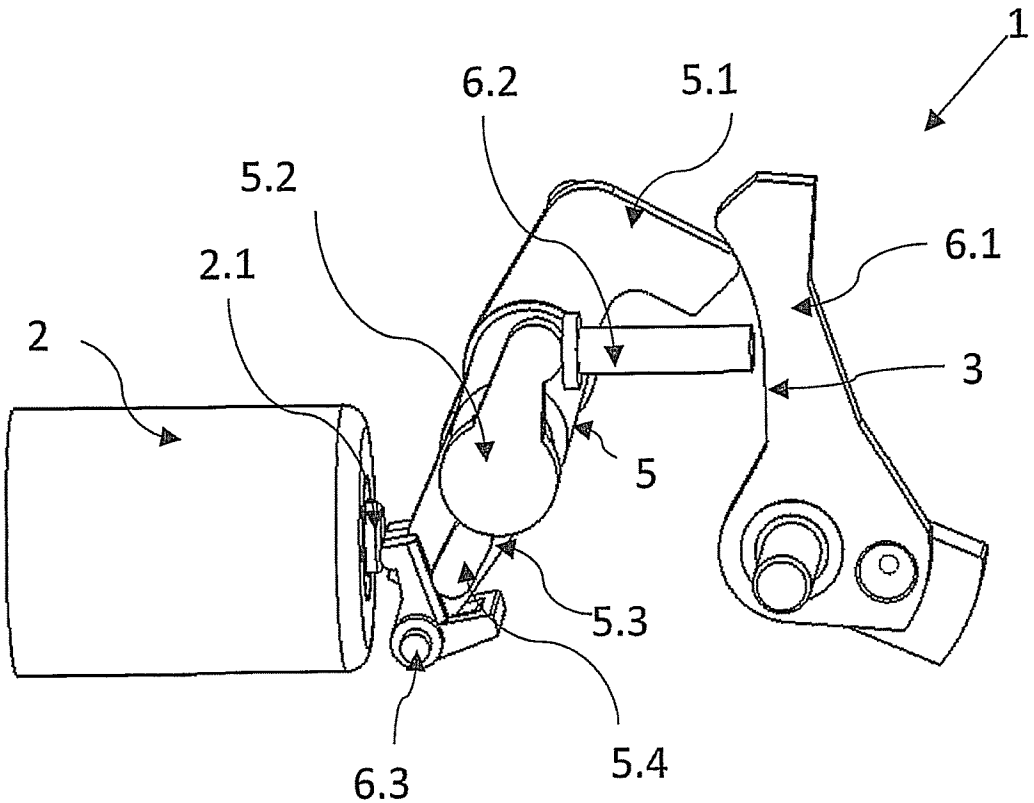
FIG. 3 is a perspective representation of the tripping apparatus in the end position thereof.

FIGS. 1 to 3 show a perspective representation of the same tripping apparatus 1, particularly for circuit breakers, in the starting position, in the intermediate position and in the end position. The tripping apparatus 1 according to an embodiment of the invention comprises a controllable tripping magnet 2 with an armature 2.1 which is operatively connected to a downstream tripping catch 6.3, which engages in a tripping mechanism that acts on the circuit breaker and is coupled to a preloaded spring 4 serving as a force amplifier. According to an embodiment of the invention, the tripping mechanism comprises a camshaft 5 having a plurality of cam lobes 5.1, 5.2, 5.4. An actuating device 6 is associated with each cam lobe 5.1, 5.2 and 5.4, respectively arranged at an offset rotational angle on the camshaft 5, wherein, when tripped, at least two actuating processes associated with the respective actuating device 6.1, 6.2, 6.3 take place consecutively, so that the full spring force is transmitted by means of the camshaft 5 to at least one of said actuating devices 6.1, 6.2, 6.3 so as to perform the relevant actuating process.

In the example shown, the camshaft 5 comprises three cam lobes 5.1, 5.2 and 5.4. The first cam lobe 5.1 is associated with a first actuating device 6 configured as a breaker mechanism lever 6.1. According to an embodiment of the invention, the rotatably mounted breaker mechanism lever 6.1 has a curve contour, the function of which will be explained in detail below. By way of the breaker mechanism lever 6.1, the breaker mechanism of a circuit breaker (not shown) is mechanically actuated and tripped. The camshaft 5, the tripping catch 6.3, the auxiliary switch pin 6.2 and the tripping magnet 2 are mounted in a housing (not shown). The spring 4 which engages with the camshaft 5 and serves as a force amplifier is also attached in the housing. The spring 4 is preloaded in the starting condition. The armature 2.1 of the controllable tripping magnet 2 is operatively connected to the tripping catch 6.3 which, with the armature 2.1 extended, releases a further blocking cam 5.3 arranged on the camshaft 5, so that the spring 4 can set the camshaft 5 into a rotational movement.

The operation of the tripping apparatus 1 according to an embodiment of the invention is as follows. In the starting position as per FIG. 1, the tripping magnet 2 or the coils thereof carry no current. The armature 2.1 is situated fully within the tripping magnet 2. The tripping catch 6.3 comprising two limbs lies with one of the limbs thereof against the end face of the armature 2.1. Also arranged beside the blocking cam 5.3 is a pusher cam 5.4.

In order to reach the intermediate position of FIG. 2, a current is fed to the tripping magnet 2 and the armature 2.1 moves axially outwardly. At this time point, both the tripping catch 6.3 and the camshaft 5 are still in their starting position. Immediately thereafter, the tripping catch 6.3 is set into rotation and, after rotating through a few degrees, releases the blocking cam 5.3 of the camshaft 5, so that the camshaft 5 is set into rotation by the preloaded spring 4.

Following this, the first and most important actuating movement of the tripping apparatus 1 takes place in that the first cam 5.1 sets the breaker mechanism lever 6.1 into rotational movement. Further actuating movements are not performed at this time. The entire spring force acting at this time point is therefore available for this first actuating movement. As the rotational movement of the camshaft 5 continues, the breaker mechanism lever 6.1 is brought into the end position thereof which, in the example shown, is achieved by a rightward rotation through a predetermined angle. On further rotation of the camshaft 5, the first cam 5.1 runs along the curve contour 3 of the breaker mechanism lever 6.1. During this phase, the cam 5.2 of the camshaft 5 associated with the auxiliary switch pin 6.2 reaches the auxiliary switch pin 6.2, moves the pin and actuates an auxiliary switch (not shown). Immediately after reaching the culmination point of the curve contour 3 of the breaker mechanism lever 6.1, the resetting of the tripping catch 6.3 and the associated resetting of the armature 2.1 of the tripping magnet 2 begin.

Figure 5:
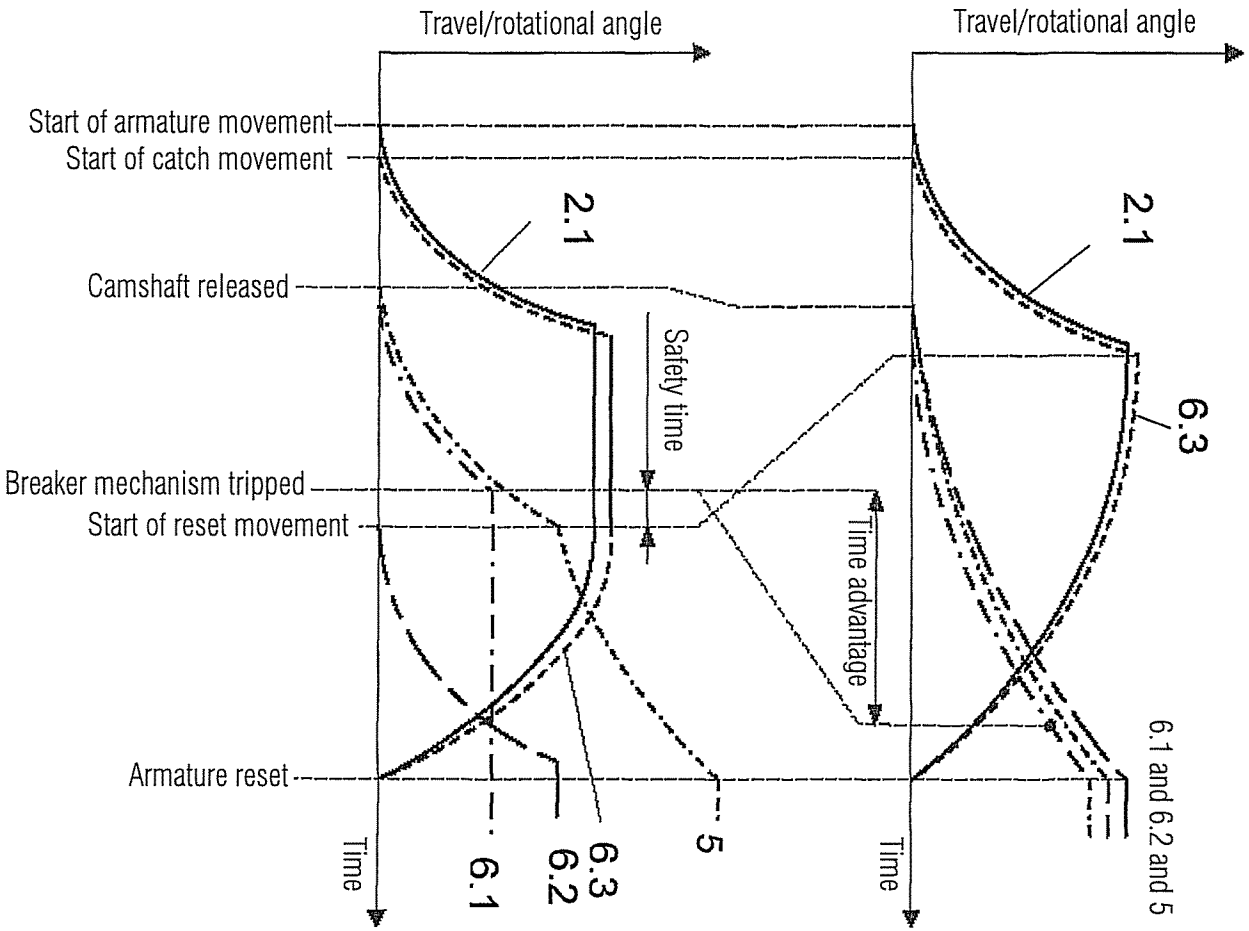
FIG. 5 is a graphical representation to illustrate the travel or rotational angle as a function of time for all actuating processes in the tripping apparatus according to an embodiment of the invention.

The graphical representations in FIGS. 4 and 5 show the travel or the rotational angle of the actuating members as a function of time. FIG. 4 represents the actuating processes of the prior art; FIG. 5 shows the corresponding actuating processes in a tripping apparatus 1 according to the prior art. As shown by FIG. 4, during the armature movement and the actuating movement of the tripping catch 6.3, the travel initially increases progressively over time. With the conventional tripping mechanism known from the prior art, on reaching the end position of the tripping catch 6.3, the actuating processes of tripping a breaker mechanism and actuation of an auxiliary switch begin. During this phase, the resetting of the tripping catch 6.3 and the associated resetting of the armature 2.1 of the tripping magnet 2 also take place. All three or four actuating processes end at approximately the same time. During the rotational movement of the camshaft 5, the spring 4 provided for driving the tripping mechanism releases the spring energy thereof and simultaneously distributes the energy among all three or four actuating processes, and this is associated with the aforementioned disadvantages.

With the tripping apparatus according to an embodiment of the invention of FIGS. 1 to 3, however, the spring energy is distributed among the individual actuating processes at different times, as shown in FIG. 5, and as described below:

Firstly, a current is fed to the tripping magnet 2 or the coils thereof and the armature 2.1 moves in the axial direction of the tripping catch 6.3. Somewhat before the armature 2.1 and the tripping catch 6.3 have reached the maximum deflection thereof, the catch releases the camshaft 5. Said camshaft begins to rotate and drives exclusively the breaker mechanism lever 6.1 by way of the first cam lobe 5.1. The full spring force is available for this actuating process.

Only after reaching the maximum rotational angle, which corresponds to the final position of the breaker mechanism lever 6.1, are all the further actuating processes tripped, offset temporally. First, the tripping catch 6.3 is reset, which simultaneously moves the armature 2.1 back into the starting position. Between the temporal end of the movement of the breaker mechanism lever 6.1 and the start of the actuating movement of the second cam lobe 5.2 of the camshaft 5 starting shortly thereafter for actuating the auxiliary switch pin 6.2 and the resetting movement of the armature 2.1, there is a safety timespan. However, all the aforementioned actuating processes, apart from the actuating movement of the breaker mechanism lever 6.1, end at approximately the same time point.

It can be seen from an overview of FIGS. 4 and 5 that the tripping apparatus 1 according to the invention has a significant time advantage over the prior art tripping mechanism with regard to the assumption of the end position of the breaker mechanism 6.1. In other words, the breaker mechanism acting on the circuit breaker is tripped more rapidly due to the actuating processes starting temporally offset, since the total spring force is concentrated on the process that is important at each respective time point.

Figure 6:
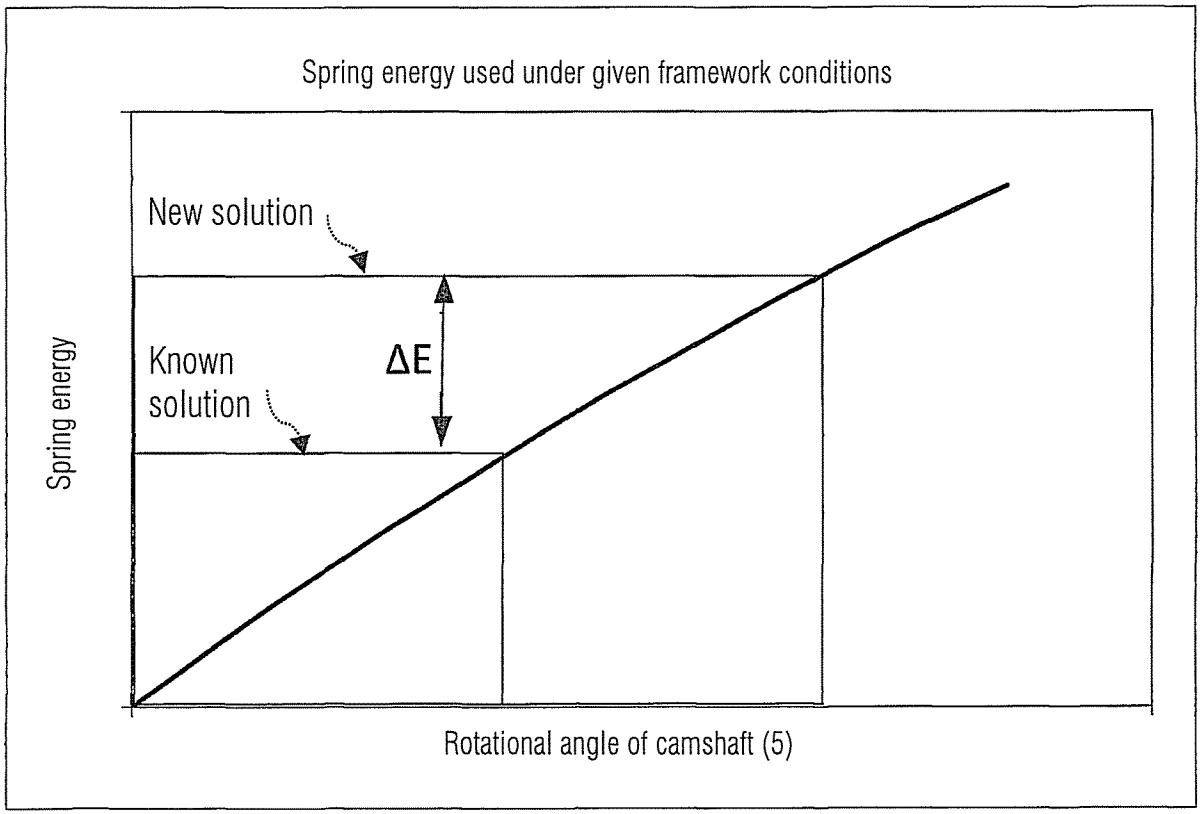
FIG. 6 is a comparative graphical representation of the spring energy used in the prior art and in the tripping apparatus according to an embodiment of the invention.

FIG. 6 shows a comparative graphical representation of the spring energy used as per the prior art and in the tripping arrangement 1 according to an embodiment of the invention with the given framework conditions. In the graph, the spring energy is applied over the rotational angle of the camshaft 5. With the solution known from the prior art, the rotational angle of the tripping shaft is smaller than the rotational angle of the camshaft 5 according to an embodiment of the invention. Along with this goes the spring energy used which is associated with the rotational angle, said energy being less with the tripping shaft of the known solution than with the camshaft 5 of the solution according to the invention. The greater value with the invention corresponds to the available LE of the usable spring energy.

The different rotational angle of the camshaft 5 according to an embodiment of the invention relative to the conventional tripping shaft leads thereto that with an embodiment of the invention, the available spring energy can be more efficiently used while, simultaneously, the actuating process of tripping the breaker mechanism 6.1 begins at an earlier time point and is completed quicker. However, the tripping apparatus 1 is only reset once the breaker mechanism lever 6.1 has assumed the end position thereof.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

REFERENCE SIGNS

1 Tripping apparatus
2 Tripping magnet
2.1 Armature
3 Curve contour
4 Spring
5 Camshaft
5.1 First cam lobe
5.2 Second cam lobe
5.3 Blocking cam
5.4 Pusher cam
6 Actuating means
6.1 Breaker mechanism lever
6.2 Auxiliary switch pin
6.3 Tripping catch

The invention claimed is:

1. A tripping apparatus for a circuit breaker, comprising:

at least a controllable tripping magnet including an armature operatively connected to a downstream tripping catch, which engages in a tripping mechanism that acts on the circuit breaker and is coupled to a preloaded spring serving as a force amplifier, the tripping mechanism comprising a camshaft including a plurality of cam lobes;

an actuating device associated with each of the plurality of cam lobes, each actuating device respectively arranged at an offset rotational angle, wherein when the tripping apparatus is tripped, at least two actuating processes associated with the actuating devices take place consecutively, so that the full spring force is transmitted by way of the camshaft to at least one of said actuating devices so as to perform a relevant actuating process, and a first one of the actuating devices is configured as a breaker mechanism lever of a breaker mechanism, and comprises a curved contour which is configured such that, after the breaker mechanism lever reaches an end position thereof, upon a further rotational movement of the camshaft caused by the spring force, the cam lobe associated with the breaker mechanism lever slides along the curved contour such that the rotational angle of the camshaft increases without the end position of the breaker mechanism lever changing.

2. The tripping apparatus as claimed in claim 1, wherein the actuating processes provided are the tripping of the breaker mechanism, an actuating of an auxiliary switch, a reset movement of the tripping catch and a resetting of the armature of the tripping magnet, and wherein the tripping of the breaker mechanism is a time-critical main function which takes place first and at maximum speed.

3. The tripping apparatus as claimed in claim 1, wherein the respective actuating processes take place at least partially one after the other, and wherein, between an end of one actuating process and a start of a subsequent actuating process, there is a safety timespan.

4. The tripping apparatus as claimed in claim 1, wherein the actuating devices perform a linear or rotational actuating movement.

5. The tripping apparatus as claimed in claim 1, wherein the actuating devices include at least second and third actuating devices, the second actuating device being configured as an auxiliary switch pin of an auxiliary switch and the third actuating device being configured as a tripping catch.

6. The tripping apparatus as claimed in claim 1, wherein a usable travel of the spring increases and the energy utilization at a given maximum force increases as the rotational angle of the camshaft increases.

7. The tripping apparatus as claimed in claim 2, wherein the reset movement of the tripping catch takes place only after the breaker mechanism lever reaches the end position thereof and after an associated, but temporally offset, reset movement of the armature of the tripping magnet.

8. The tripping apparatus as claimed in claim 1, wherein, in order to obtain the shortest switching times, the first actuating device has fully completed the actuating process thereof before further actuating processes are tripped by the cam lobes of the camshaft.

9. The tripping apparatus as claimed in claim 2, wherein the movement of the camshaft is transmitted to the breaker mechanism lever by a coupling mechanism.

10. The tripping apparatus as claimed in claim 1, wherein an angle between the two spring attachments and a rotation point of the camshaft is selected such that a work function of the spring is a maximum at a given rotational angle of the camshaft.

11. The tripping apparatus as claimed in claim 2, wherein the respective actuating processes take place at least partially one after the other, and wherein, between an end of one actuating process and a start of a subsequent actuating process, there is a safety timespan.

12. The tripping apparatus as claimed in claim 6, wherein a usable travel of the spring increases and the energy utilization at a given maximum force doubles as the rotational angle of the camshaft increases.

* * * * *